US008424272B2

(12) United States Patent
Cerf

(10) Patent No.: US 8,424,272 B2
(45) Date of Patent: Apr. 23, 2013

(54) APPARATUS AND PROCESS FOR WRAPPING AN ARTICLE WITH A HEAT SHRINK FILM HAVING A STRIP THAT ACTS AS A HANDLE

(76) Inventor: Alain Cerf, North Reddington Beach, FL (US)

( * ) Notice: Subject to any disclaimer, the term of this patent is extended or adjusted under 35 U.S.C. 154(b) by 1087 days.

(21) Appl. No.: 11/898,885

(22) Filed: Sep. 17, 2007

(65) Prior Publication Data

US 2009/0071102 A1 Mar. 19, 2009

(51) Int. Cl.

| | |
|---|---|
| ***B65B 61/14*** | (2006.01) |
| ***B65B 53/02*** | (2006.01) |
| ***B65D 71/08*** | (2006.01) |
| ***B65D 71/28*** | (2006.01) |

(52) U.S. Cl.

USPC ..... 53/413; 53/442; 53/134.1; 53/557; 206/428; 206/432

(58) Field of Classification Search ..... 53/410, 53/413, 441, 134.1, 135.2, 135.4, 176, 210, 53/128.1, 442, 463, 557, 209; 206/428, 432

See application file for complete search history.

(56) References Cited

U.S. PATENT DOCUMENTS

| | | | | | |
|---|---|---|---|---|---|
| 3,111,221 | A | * | 11/1963 | Chapman et al. | 206/147 |
| 3,557,516 | A | * | 1/1971 | Brandt | 53/397 |
| 3,866,386 | A | * | 2/1975 | Ganz | 53/398 |
| 3,892,057 | A | * | 7/1975 | Goode | 53/397 |
| RE28,535 | E | * | 9/1975 | Ganz | 53/398 |
| 4,050,216 | A | * | 9/1977 | Stenberg | 53/413 |
| 4,700,528 | A | * | 10/1987 | Bernard | 53/398 |
| 4,716,707 | A | * | 1/1988 | Gambetti | 53/134.1 |
| 4,815,589 | A | * | 3/1989 | Allen et al. | 206/432 |
| 4,830,895 | A | * | 5/1989 | Bernard | 428/34.2 |
| 5,369,936 | A | * | 12/1994 | Callahan et al. | 53/415 |
| 6,739,115 | B1 | * | 5/2004 | Malini | 53/588 |
| 2005/0132665 | A1 | * | 6/2005 | Angelini | 53/134.1 |
| 2005/0160700 | A1 | * | 7/2005 | Zumbiel et al. | 53/413 |

FOREIGN PATENT DOCUMENTS

| | | | | |
|---|---|---|---|---|
| JP | 10059418 | A | * | 3/1998 |
| JP | 11348940 | A | * | 12/1999 |
| JP | 2005082217 | A | * | 3/2005 |

* cited by examiner

*Primary Examiner* — Stephen F Gerrity
(74) *Attorney, Agent, or Firm* — Sam Silverberg

(57) ABSTRACT

The objective of this invention is to provide a handle for carrying an article or a bundle of bottles that is more resistant to tearing and delaminating and has the ability to carry heavy loads. This is accomplished by placing a strip on the inside of the wrapping material and wrapping an article, so that the strip that forms the handle is enclosed within the wrapping material. By placing the handle inside the wrapping material so that the strip overlaps when the wrapping material covers the article, the handle is capable of carrying heavy loads.

16 Claims, 2 Drawing Sheets

APPARATUS AND PROCESS FOR WRAPPING AN ARTICLE WITH A HEAT SHRINK FILM HAVING A STRIP THAT ACTS AS A HANDLE

FIELD OF INVENTION

This invention relates to wrapping an article with a heat shrink film having handle. In particular this invention acts as a strip that acts as a handle, wherein the strip is completely enclosed inside the wrapping film.

This application incorporated by reference pending U.S. patent application Ser. No: 11/582,409 filed Oct. 18, 2006 titled "Perforated Film Wrapping Machine" by the same inventor.

BACKGROUND OF THE INVENTION

Usually handles are applied to the wrapping materials on the outside of a bundle or a wrapped article. The article is usually applied to a shrink heat bundle as a pack of 12 or 24 plastic bottles. The handle is usually glued on the outside of the pack. The term article will be used to mean a single article as well as collection of articles such as collection of bottles. The adhesion of the glued handles to the wrapping material can be affected by heat and dryness of heat shrunk film and the quality of the glue. These handles have a tendency to delaminate as the load increases.

SUMMARY OF THE INVENTION

The objective of this invention is to provide a handle for carrying an article or a bundle of bottles that is more resistant to tearing and delaminating and has the ability to carry heavy loads. This is accomplished by placing a strip on the inside of the wrapping material and wrapping an article, so that the strip that forms the handle is enclosed within the wrapping material. By placing the handle inside the wrapping material so that the strip overlaps when the wrapping material covers the article, the handle is capable of carrying heavy loads The handle film strip is applied onto the heat shrink film prior to the film being separated. The strip of material has to be applied at a sufficient distance from the separation to ensure that there is adequate amount of film to form the handle and to provide an overlap.

DETAILED DESCRIPTION OF THE INVENTION

Figure 1:
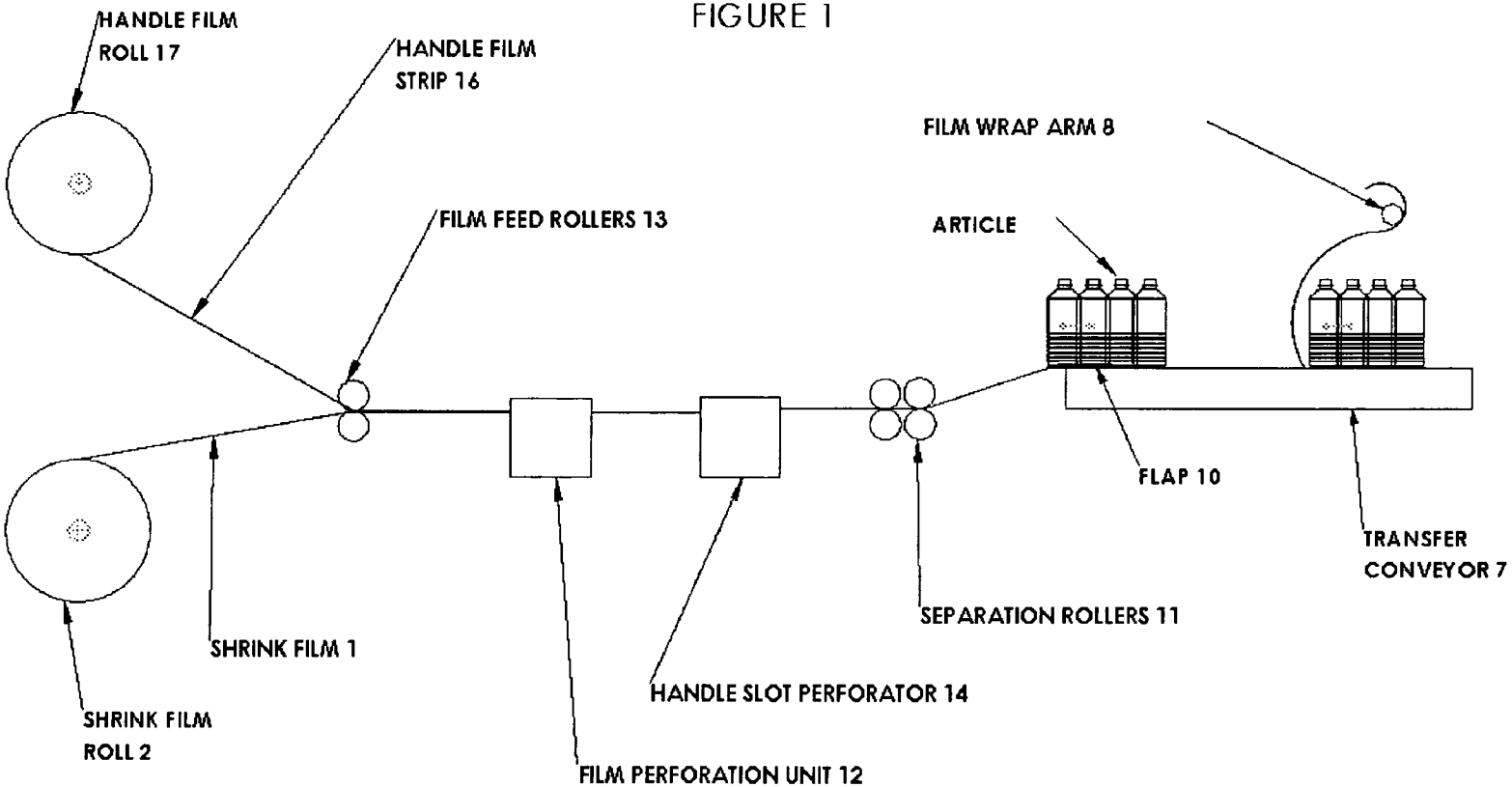
FIG. 1 shows a handle strip being applied to a heat shrink film for wrapping a bundle of bottles.
Figure 2:
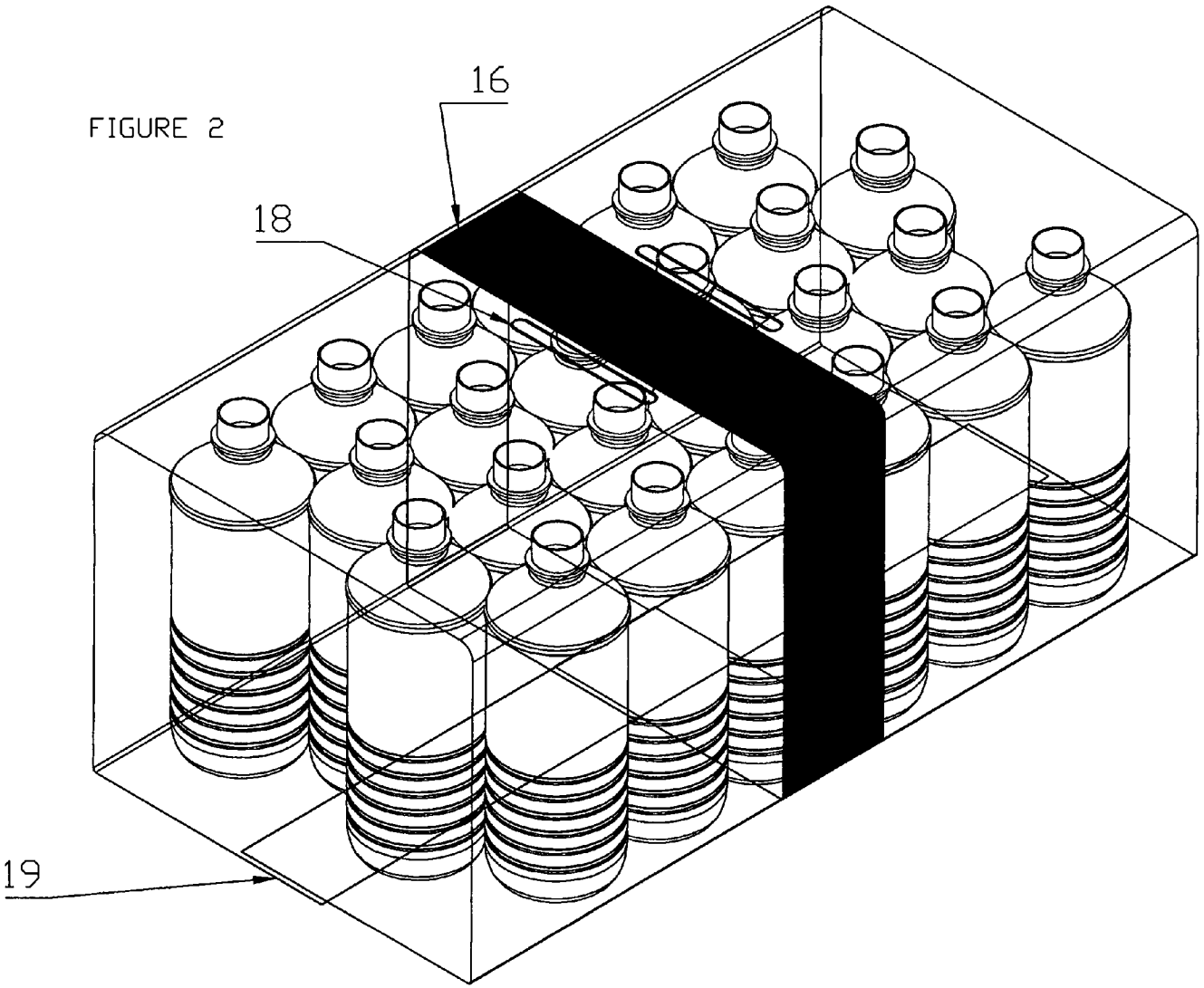
FIG. 2 shows a bundle of bottles wrapped in heat shrink film with a handle encased within the heart shrink film

FIG. 1 is similar to FIG. 2 of pending U.S. patent application Ser. No. 11/582,409 filed Oct. 18, 2006 to Alain Cerf. The operation of the machine using perforations has been disclosed in this application.

FIG. 1 of this invention shows the handle strip of plastic material 16 being fed on to a shrink film 1 prior to the separation of the film by separation rollers 11. The strip 16 is usually fed at the same time as film 1 is advanced. The strip 16 is usually the same length of as the plastic film to ensure that the strip overlaps. The strip 16 should be made of a material which will adhere to the film 1. The strip 16 can be made of the same as film 1. When the same material is used for the strip and film better adhesion is usually achieved. The carrying load will dictate the thickness and width of the strip. Usually a 2 mil thickness is required. The film with the applied strip is next fed to a perforation machine 12 where the strip and film are perforated by the same blade at the same time. The teeth of the blades can be modified to accommodate various strip thicknesses. The perforations allow the strip to be separated with predetermine lengths. After perforation, two slots 18 are provided adjacent to the strip to allow ones fingers to grip and carry the article. Afterwards the film 1 with strip 16 is separated along the perforation line by separation rollers 11. The film 1 with strip 16 is pulled off the roll 2 and a flap 10 of the film with strip 16 is pushed onto belt conveyor 7. An article 20 is placed on the flap 10. Bar 8 wraps the article. When the article is moved to the heat shrink conveyor the flap is overlapped. The overlap 19 at the position of the strip creates a sandwich of strip with underlayers of film, strip and film. When the wrapped article is heat shrunk the strip will seal to the film in at least in some areas to provide a good bond for the handle. The sealing of the overlap with the film and strip creates a strong bond that allows the handle to carry heavy loads.

The strip can be printed. The printing can be a bar code or a brand. This might avoid the need to print the heat shrink film.

This application incorporates by reference U.S. patent Ser. No. 11/582,408 filed Oct. 18, 2006 by the same inventor. The title of the application is "Adjustable Height Film Wrapping Machine."

The invention claimed is:

1. An apparatus for wrapping an article with a film having a strip comprising;

means for providing a film having a strip applied to the film that acts as an handle means for providing an opening in the film having a strip prior to heat shrinking the film that would allow one to grip the handle, means for wrapping the film having the strip over an the article so that the strip is enclosed in the wrapping film and the film is overlapped, and without bonding the overlap, and means for heat shrinking the wrapped article with non bonded overlapped film so that the strip will seal to the film in at least some areas and seal the overlapped film.

2. An apparatus according to claim 1 having means for perforating the strip and film at the same time to provide a predetermined length of film.

3. An apparatus according to claim 2 having means for applying the strip to the film prior to perforating the film and strip.

4. An apparatus according to claim 1 wherein the means for providing a film with a. strip includes means to ensure that the strip and film are at substantially the same length for wrapping the article so that the overlap has a film with a strip overlaid with a film with a strip.

5. An apparatus according to claim 1 including means to make openings in the film adjacent the handle to allow one to grip the handle.

6. A process for wrapping an article with heat shrink film having a strip that acts as a handle comprising, applying a strip on a film that acts as a handle, providing openings in the film having a strip prior to heat shrinking the film that would allow one to grip the handle, wrapping the film having the strip over the article so that the strip is enclosed in the wrapping film, and the film is overlapped, and heat shrinking the wrapped article whereby the strip will seal to the film in at least some areas.

7. A process according to claim 6 including perforating the film to provide a predetermined length of film for wrapping the article.

8. A process according to claim 7 wherein the strip and film are substantially the same length.

9. A process according to claim 8 wherein the overlap has the strip sandwiched between two layers of film so that the strip is sealed to both layers of film.

10. A process according to claim 7 wherein the strip is applied to the film prior to perforating the film.

11. A process according to claim 6 includes wrapping an article so that the overlap has the strip sandwiched between two layers of film so that the heat shrinking seals the strip to both lavers of film.

12. A process according to claim 6 wherein the film and strip are made of the same material.

13. A process according to claim 6 consisting essentially of for wrapping an article with heat shrink film having a strip that acts as a handle comprising, applying a strip on a film that acts as a handle, providing openings in the film having a strip prior to heat shrinking the film that would allow one to grip the handle, wrapping the film having the strip over the article so that the strip is enclosed in the wrapping film and the film is overlapped, and heat shrinking the wrapped article whereby the strip will seal to the film in at least some areas.

14. A process for wrapping an article according to claim 6 wherein the strip is not bonded to the film prior to wrapping the film over the article.

15. A process for wrapping an article according to claim 14 wherein the strip is not bonded to the film with a glue.

16. An article produced by the process of claim 11.

* * * * *